US009114956B2

(12) United States Patent
Kawakami et al.

(10) Patent No.: US 9,114,956 B2
(45) Date of Patent: Aug. 25, 2015

(54) ELEVATOR MODIFICATION WORK APPARATUS

(75) Inventors: Shigenobu Kawakami, Tokyo (JP); Hiroshi Narasada, Tokyo (JP); Seiji Okuda, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 233 days.

(21) Appl. No.: 13/641,496

(22) PCT Filed: Jun. 18, 2010

(86) PCT No.: PCT/JP2010/060346

§ 371 (c)(1),
(2), (4) Date: Oct. 16, 2012

(87) PCT Pub. No.: WO2011/158370

PCT Pub. Date: Dec. 22, 2011

(65) Prior Publication Data

US 2013/0031777 A1 Feb. 7, 2013

(51) Int. Cl.

| | |
|---|---|
| ***B23P 19/00*** | (2006.01) |
| ***B66B 13/02*** | (2006.01) |
| ***B66B 7/00*** | (2006.01) |
| ***B66B 19/00*** | (2006.01) |
| ***B66B 5/00*** | (2006.01) |

(52) U.S. Cl.

CPC ..... *B66B 19/005* (2013.01); *B66B 5/0087* (2013.01); *Y10T 29/53143* (2015.01)

(58) Field of Classification Search

USPC ..... 29/732; 187/315, 414

See application file for complete search history.

(56) References Cited

U.S. PATENT DOCUMENTS

| | | | | |
|---|---|---|---|---|
| 4,577,399 | A * | 3/1986 | Ott | 29/733 |
| 5,761,794 | A * | 6/1998 | Choi | 29/732 |
| 5,867,892 | A * | 2/1999 | Beakes et al. | 29/732 |

(Continued)

FOREIGN PATENT DOCUMENTS

| | | | |
|---|---|---|---|
| JP | 59-82122 | A | 5/1984 |
| JP | 62-104807 | U | 7/1987 |

(Continued)

OTHER PUBLICATIONS

Office Action issued Oct. 1, 2013 in Japanese Patent Application No. 2012-520226 (with English language translation).

(Continued)

*Primary Examiner* — David Angwin

(74) *Attorney, Agent, or Firm* — Oblon, McClelland, Maier & Neustadt, L.L.P.

(57) ABSTRACT

An elevator modification work apparatus for disposing a coupling shaft mounting aperture on an end surface of a motor shaft includes a positioning member on which a recess portion is disposed into which the motor shaft is fitted. Displacement of the positioning member relative to the motor shaft in a direction that is perpendicular to the axis of the motor shaft is restricted by fitting the end portion of the motor shaft into the recess portion. A motor shaft positioning aperture that passes through the positioning member in a direction that intersects a bottom surface of the recess portion is disposed on the recess portion. A position at which to dispose the coupling shaft mounting aperture on the end surface of the motor shaft is specified by a position of the motor shaft positioning aperture when the end portion of the motor shaft is fitted into the recess portion.

7 Claims, 7 Drawing Sheets

(56) References Cited

U.S. PATENT DOCUMENTS

| | | | | |
|---|---|---|---|---|
| 6,481,546 | B2 * | 11/2002 | Oliver et al. | 188/267.1 |
| 6,909,213 | B2 * | 6/2005 | Frey et al. | 310/77 |
| 7,975,370 | B2 * | 7/2011 | Becherucci et al. | 29/732 |

FOREIGN PATENT DOCUMENTS

| | | | |
|---|---|---|---|
| JP | 4-102729 | U | 9/1992 |
| JP | 5-309530 | A | 11/1993 |
| JP | 8 133623 | | 5/1996 |
| JP | 9-38828 | A | 2/1997 |
| JP | 3630442 | | 3/2005 |
| JP | 2006 112965 | | 4/2006 |
| JP | 2006112965 | * | 4/2006 |
| JP | 2006 176325 | | 7/2006 |
| JP | 2007 161416 | | 6/2007 |

OTHER PUBLICATIONS

Internaional Search Report Issued Dec. 7, 2010 in PCT/JP10/060346 Filed Jun. 18, 2010.

* cited by examiner

ELEVATOR MODIFICATION WORK APPARATUS

TECHNICAL FIELD

The present invention relates to an elevator modification work apparatus for mounting a coupling shaft to an existing motor shaft.

BACKGROUND ART

Conventionally, in order to detect a rotational position of a motor shaft, gearless elevator hoisting machines are known in which a coupling shaft is mounted to an end portion of the motor shaft, and an encoder is disposed on the coupling shaft. A plurality of screw-threaded apertures for mounting the coupling shaft on the motor shaft are formed on an end surface of the motor shaft. The coupling shaft is fixed to the motor shaft by a plurality of bolts that are screwed into the screw-threaded apertures (See Patent Literature 1).

CITATION LIST

Patent Literature

[Patent Literature 1]
Japanese Patent Laid-Open No. 2007-161416 (Gazette)

SUMMARY OF THE INVENTION

Problem to be Solved by the Invention

Conventionally, in order to improve elevator driving control systems, an encoder may be mounted to an existing hoisting machine during elevator modification work. If the encoder is mounted to the existing hoisting machine using the construction that is disclosed in Patent Literature 1, it is necessary to machine the motor shaft to form the screw-threaded apertures on the end surface of the motor shaft in order to mount the coupling shaft to the motor shaft. In such cases, operations such as measuring and scribing, for example, must be performed in order to set the position of the screw-threaded apertures on the end surface of the motor shaft precisely, making machining of the motor shaft time-consuming.

The present invention aims to solve the above problems and an object of the present invention is to provide an elevator modification work apparatus that can perform machining of the motor shaft precisely and easily.

Means for Solving the Problem

In order to achieve the above object, according to one aspect of the present invention, there is provided an elevator modification work apparatus for disposing a coupling shaft mounting aperture on an end surface of a motor shaft, wherein the elevator modification work apparatus is characterized in including a positioning member on which a recess portion is disposed, displacement of the positioning member relative to the motor shaft in a direction that is perpendicular to a shaft axis of the motor shaft being restricted by an end portion of the motor shaft being fitted into the recess portion, a motor shaft positioning aperture that passes through the positioning member in a direction that intersects a bottom surface of the recess portion being disposed on the bottom surface of the recess portion, and a position at which to dispose the coupling shaft mounting aperture on the end surface of the motor shaft being specified by a position of the motor shaft positioning aperture when the end portion of the motor shaft is fitted into the recess portion.

Effects of the Invention

In an elevator modification work apparatus according to the present invention, because the recess portion into which the end portion of the motor shaft fits is disposed on the positioning member, and the motor shaft positioning aperture that passes through the positioning member in a direction that intersects the bottom surface of the recess portion is disposed on the bottom surface of the recess portion, the position at which to dispose the coupling shaft mounting aperture on the end surface of the motor shaft can be specified precisely and easily by the motor shaft positioning aperture simply by fitting the motor shaft into the recess portion. Machining of the motor shaft can thereby be performed precisely and easily during elevator modification work.

DESCRIPTION OF EMBODIMENTS

Preferred embodiments of the present invention will now be explained with reference to the drawings.

Embodiment 1

Figure 1:
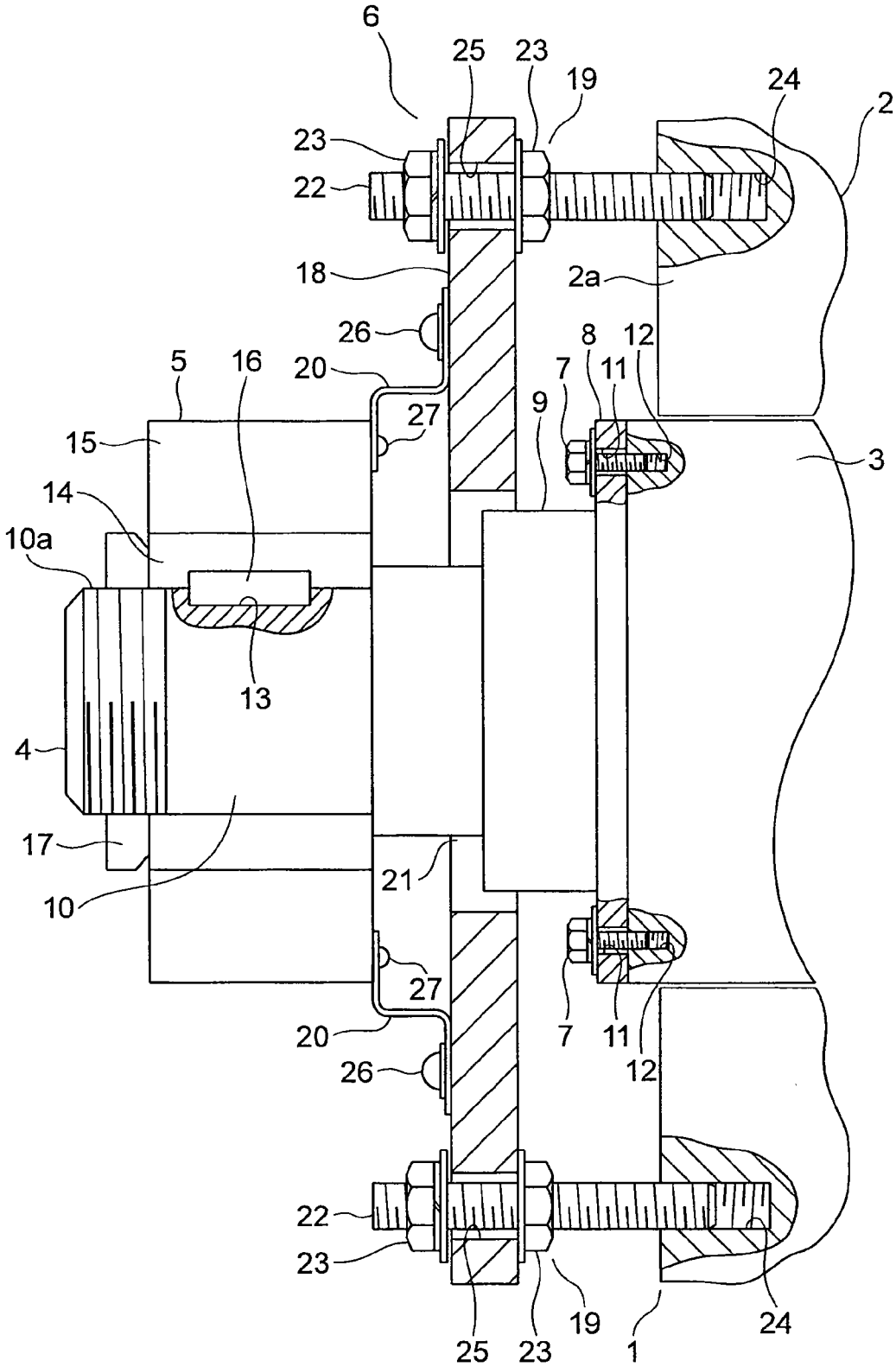
FIG. 1 is a partially cutaway side elevation that shows a state in which an encoder is mounted to an existing elevator hoisting machine according to Embodiment 1 of the present invention.

FIG. 1 is a partially cutaway side elevation that shows a state in which an encoder is mounted to an existing elevator hoisting machine according to Embodiment 1 of the present invention. In the figure, an existing hoisting machine has a motor 1 that generates a driving force that moves a car (not shown). The motor 1 has: a motor main body 2; and a motor shaft 3 that is disposed on the motor main body 2, and that is rotated by the motor main body 2. The motor main body 2 has a motor frame 2*a* that supports the motor shaft 3. The motor frame 2*a* is disposed around the motor shaft 3.

A coupling shaft 4 is mounted to an end surface of the motor shaft 3. An encoder (a rotation detector) 5 is mounted to the coupling shaft 4. A holding apparatus (external equipment) 6 that holds the encoder 5 is mounted to the motor frame 2*a*. The coupling shaft 4, the encoder 5, and the holding apparatus 6 are newly mounted to an existing motor 1 by elevator modification work.

The coupling shaft 4 is fixed to the end surface of the motor shaft 3 by a plurality of bolts 7. The coupling shaft 4 is disposed so as to be coaxial to the motor shaft 3. The coupling shaft 4 has: a tabular coupling shaft mount portion 8 that is placed in contact with the end surface of the motor shaft 3; a boss portion 9 that is disposed on the coupling shaft mount portion 8; and a detector mounting shaft portion 10 that protrudes outward from the boss portion 9 away from the motor shaft 3.

A plurality of bolt passage apertures 11 through which the bolts 7 are passed are disposed on the coupling shaft mount portion 8. A plurality of screw-threaded apertures (coupling shaft mounting apertures) 12 for mounting the coupling shaft 4 on the end surface of the motor shaft 3 are disposed on the end surface of the motor shaft 3 so as to be aligned with positions of the bolt passage apertures 11. In this example, the respective screw-threaded apertures 12 are disposed so as to be uniformly spaced in a circumferential direction of the motor shaft 3. A depth direction of the respective screw-threaded apertures 12 is oriented in an axial direction of the motor shaft 3. The respective screw-threaded apertures 12 are formed newly on the end surface of an existing motor shaft 3 by elevator modification work. The coupling shaft 4 is fixed to the end surface of the motor shaft 3 by the bolts 7 being passed through the bolt passage apertures 11, screwed into the respective screw-threaded apertures 12, and fastened.

An outside diameter of the boss portion 9 is smaller than an outside diameter of the coupling shaft mount portion 8, and an outside diameter of the detector mounting shaft portion 10 is smaller than the outside diameter of the boss portion 9. A screw-threaded portion 10*a* is disposed on a tip end portion of the detector mounting shaft portion 10. A keyway 13 that is parallel to the shaft axis of the coupling shaft 4 is disposed on an intermediate portion of the detector mounting shaft portion 10.

The encoder 5 has: a rotating portion 14 that is rotated together with the detector mounting shaft portion 10; and an annular fixed portion 15 that surrounds the rotating portion 14. The fixed portion 15 generates a signal that corresponds to the rotation of the rotating portion 14. The signal from the fixed portion 15 is sent to a controlling apparatus (not shown) through a signal wire. The controlling apparatus controls elevator operation based on the signal from the encoder 5.

A key 16 that prevents positional drift of the rotating portion 14 relative to the detector mounting shaft portion 10 is inserted into the keyway 13. The fixed portion 15 is held by the holding apparatus 6. A bearing nut 17 that prevents the encoder 5 from dislodging from the detector mounting shaft portion 10 is screwed onto the screw-threaded portion 10*a*.

The holding apparatus 6 has: a mounting plate 18; a supporting apparatus 19 that is mounted to the motor frame 2*a*, and that supports the mounting plate 18; and leaf springs 20 that are mounted to the mounting plate 18, and constitute an elastic body that is connected to the fixed portion 15.

A penetrating aperture 21 through which the coupling shaft 4 is passed is disposed on a central portion of the mounting plate 18. The mounting plate 18 is supported by the supporting apparatus 19 when the coupling shaft 4 is passed through to the penetrating aperture 21.

The supporting apparatus 19 has: a plurality of studs (screw-threaded rods) 22 that are respectively mounted to the motor frame 2*a*; and a plurality of nuts 23 that are screwed onto the respective studs 22 to hold the mounting plate 18 on the respective studs 22.

A plurality of screw-threaded apertures (external equipment mounting apertures) 24 for mounting the respective studs 22 to the motor frame 2*a* are disposed on the motor frame 2*a*. In this example, the respective screw-threaded apertures 24 are disposed so as to be uniformly spaced in a circumferential direction of the motor shaft 3. A depth direction of the respective screw-threaded apertures 24 is oriented in an axial direction of the motor shaft 3. The respective screw-threaded apertures 24 are formed newly on the end surface of an existing motor frame 2*a* by elevator modification work. The respective studs 22 are mounted to the motor frame 2*a* by being screwed into the respective screw-threaded apertures 24.

A plurality of stud passage apertures 25 through which the studs 22 are respectively passed are disposed on the mounting plate 18. The mounting plate 18 is held by the respective studs 22 so as to be held between first and second nuts 23 that are screwed onto each of the studs 22. Consequently, a position of the mounting plate 18 relative to the motor shaft 3 in an axial direction of the motor shaft 3 is adjustable by adjusting an amount of thread engagement of each of the nuts 23 on each of the studs 22.

A first end portion of each of the leaf springs 20 is connected to the mounting plate 18 by a screw 26, and a second end portion of each of the leaf springs 20 is connected to the fixed portion 15 by a screw 27. The fixed portion 15 is thereby held elastically by the leaf springs 20.

During elevator modification work, the existing motor 1 is machined using the modification work apparatus in order to form the respective screw-threaded apertures 12 on the end surface of the existing motor shaft 3, and to form the respective screw-threaded apertures 24 on the existing motor frame 2*a*.

Figure 2:
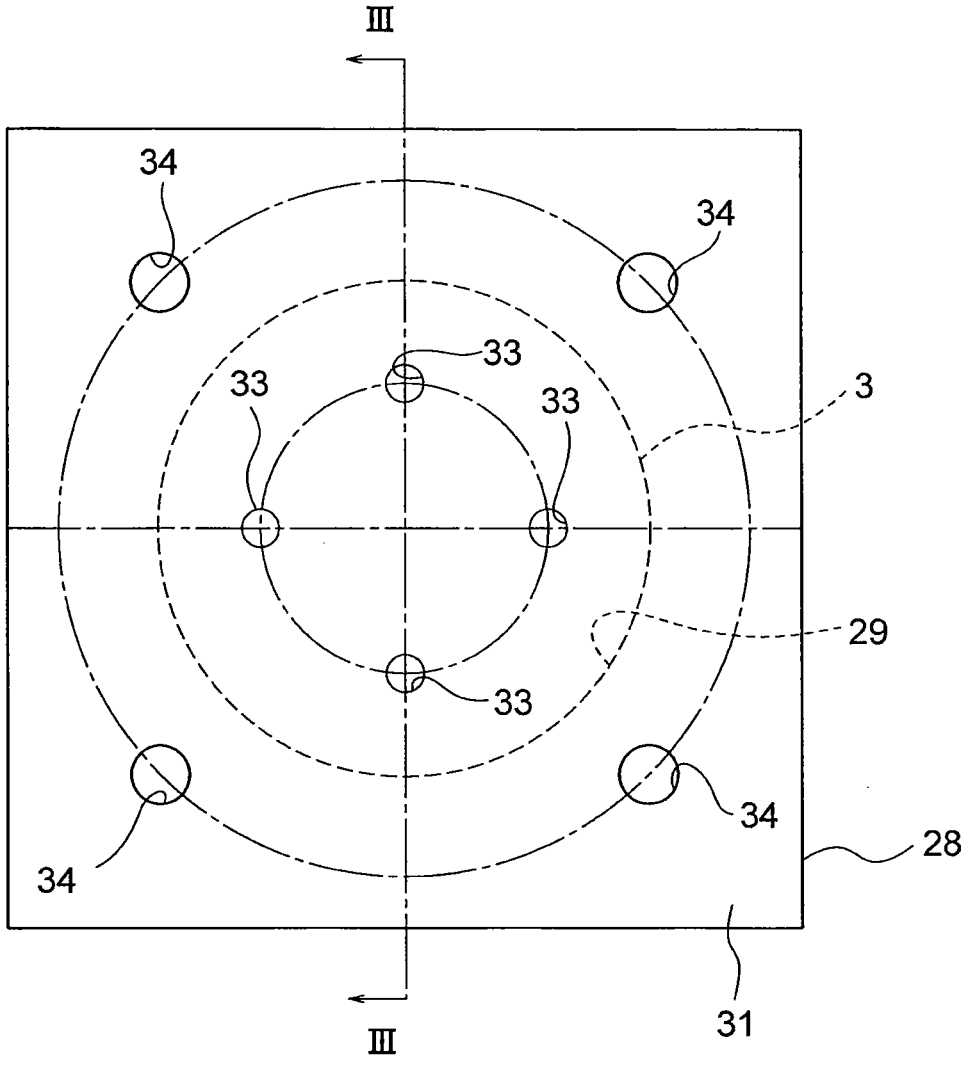
FIG. 2 is a front elevation that shows a state in which a modification work apparatus according to Embodiment 1 of the present invention is mounted to an existing motor.
Figure 3:
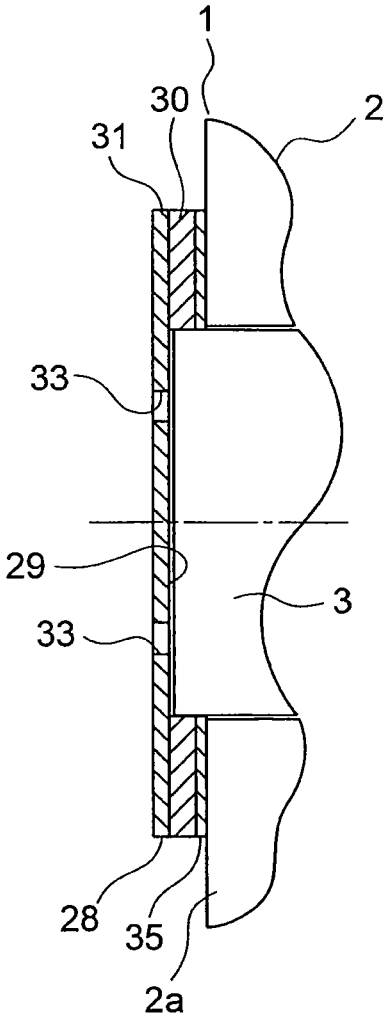
FIG. 3 is a cross section that is taken along line III-III in FIG. 2.

FIG. 2 is a front elevation that shows a state in which a modification work apparatus according to Embodiment 1 of the present invention is mounted to an existing motor 1. FIG. 3 is a cross section that is taken along line III-III in FIG. 2. The modification work apparatus has a tabular positioning member 28 that is mountable to and removable from the motor 1. A recess portion 29 into which an end portion of the motor shaft 3 is inserted is disposed on the positioning member 28. A depth direction of the recess portion 29 is oriented in a thickness direction of the positioning member 28. A cross-sectional shape of the recess portion 29 in a plane that is perpendicular to the depth direction of the recess portion 29 is a circular shape into which the end portion of the motor shaft 3 fits without gaps. In this example, an inside diameter of the recess portion 29 is constant in the depth direction of the recess portion 29. In this example, an external shape of the positioning member 28 is rectangular, as shown in FIG. 2.

The positioning member 28 is mounted to the motor 1 by fitting the end portion of the motor shaft 3 into the recess portion 29. When the positioning member 28 is mounted to the motor 1, displacement of the positioning member 28 relative to the motor shaft 3 is permitted in a direction of rotation of the motor shaft 3, but is restricted in a direction that is perpendicular to the shaft axis of the motor shaft 3.

As shown in FIG. 3, the positioning member 28 has a first plate 30 and a second plate 31 that are stacked on each other. The first plate 30 is affixed to the second plate 31. In this example, respective external shapes of the first plate 30 and the second plate 31 are identical rectangular shapes.

Figure 4:
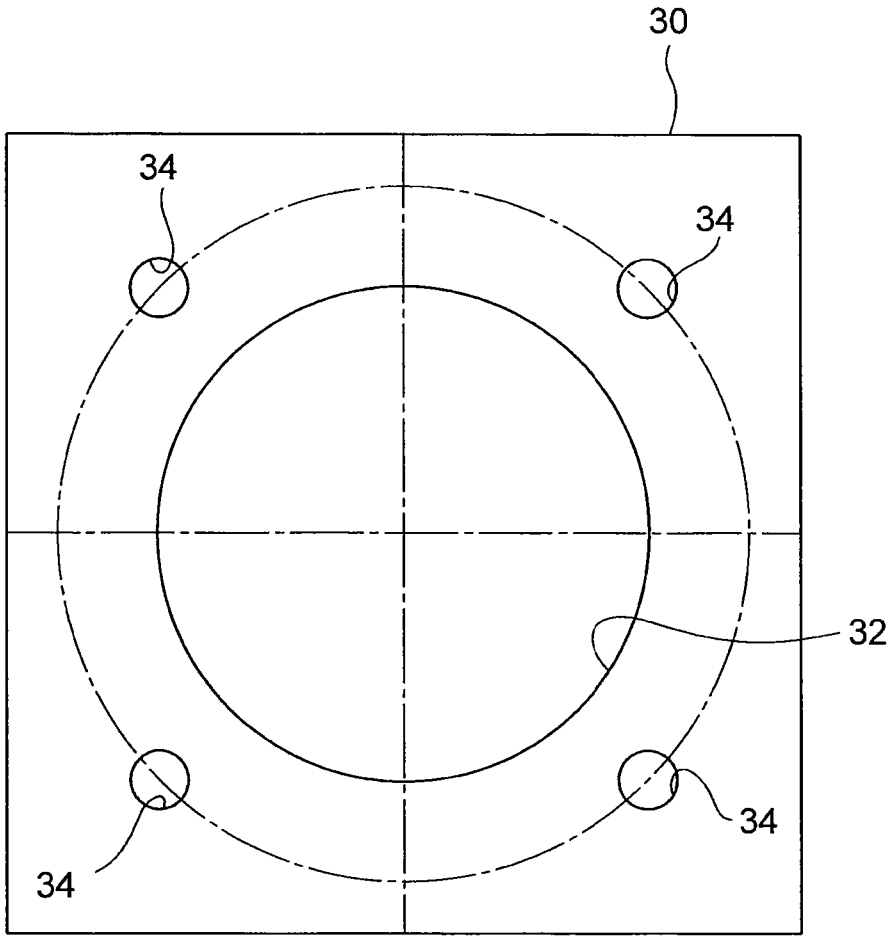
FIG. 4 is a front elevation that shows a first plate from FIG. 3.
Figure 5:
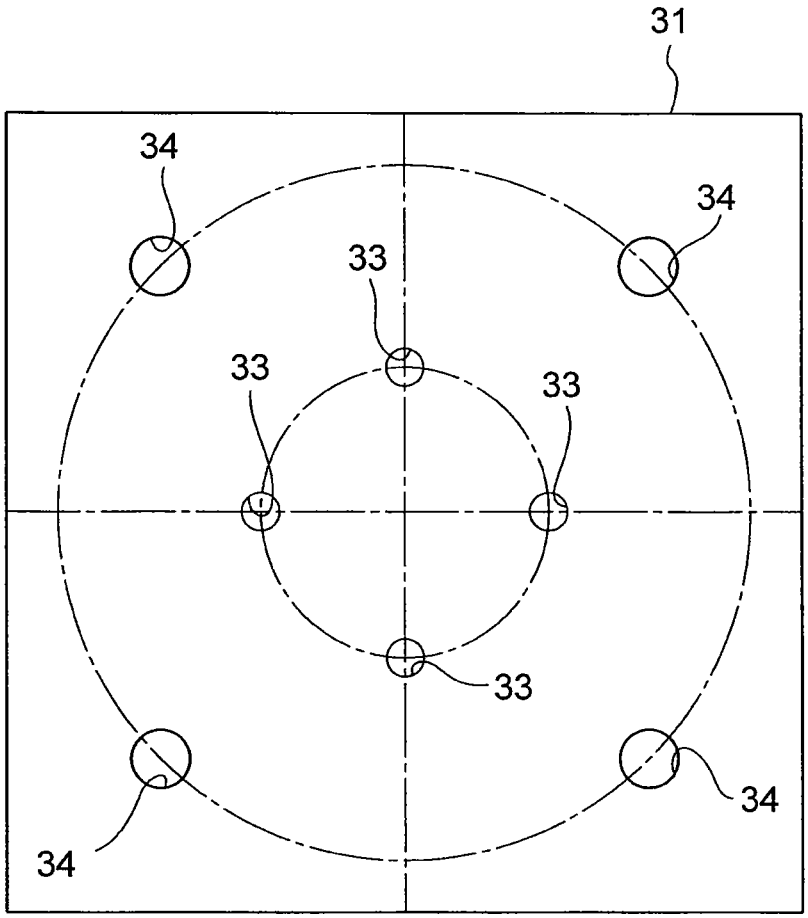
FIG. 5 is a front elevation that shows a second plate from FIG. 3.

Now, FIG. 4 is a front elevation that shows the first plate 30 from FIG. 3, and FIG. 5 is a front elevation that shows the second plate 31 from FIG. 3. A plate penetrating aperture 32 that forms an inner surface of the recess portion 29 is disposed on the first plate 30. The plate penetrating aperture 32 passes through the first plate 30 in a thickness direction of the first plate 30. The plate penetrating aperture 32 is a circular aperture (a round aperture) that has an inside diameter into which the end portion of the motor shaft 3 fits without gaps.

The second plate 31 is stacked on the first plate 30 so as to close one opening portion of the plate penetrating aperture 32. Consequently, a portion of the second plate 31 is exposed inside the plate penetrating aperture 32 as a bottom surface of the recess portion 29. In other words, the recess portion 29 is formed by a portion of the second plate 31 and the plate penetrating aperture 32.

A plurality of (in this example, four) motor shaft positioning apertures 33 for specifying positions at which to dispose the respective screw-threaded apertures 12 (FIG. 1) relative to the end surface of the motor shaft 3 are disposed on the bottom surface of the recess portion 29. The respective motor shaft positioning apertures 33 are disposed so as to be aligned with the positions of the bolt passage apertures 11 (FIG. 1) of the coupling shaft 4. In this example, as shown in FIG. 4, the respective motor shaft positioning apertures 33 are disposed so as to be uniformly spaced in a circumferential direction around a center line of the recess portion 29. The respective motor shaft positioning apertures 33 also pass through the second plate 31 in a direction that intersects the bottom surface of the recess portion 29. In this example, the respective motor shaft positioning apertures 33 pass through the second plate 31 in the depth direction of the recess portion 29.

The positions at which to dispose the respective screw-threaded apertures 12 on the end surface of the motor shaft 3 are specified by the positions of the respective motor shaft positioning apertures 33 when the end portion of the motor shaft 3 is inserted into the recess portion 29. In other words, the positions that face the respective motor shaft positioning apertures 33 on the end surface of the motor shaft 3 when the end portion of the motor shaft 3 is inserted into the recess portion 29 (i.e., the positions on the shaft axes of the respective motor shaft positioning apertures 33 on the end surface of the motor shaft 3) are specified as the positions at which to dispose the respective screw-threaded apertures 12 on the end surface of the motor shaft 3.

A plurality of (in this example, four) motor frame positioning apertures 34 for specifying positions at which to dispose the respective screw-threaded apertures 24 (FIG. 1) relative to the end surface of the motor frame 2*a* are disposed on the positioning member 28. The respective motor frame positioning apertures 34 pass through the positioning member 28. The positions of the respective motor frame positioning apertures 34 are positions that are radially outside the recess portion 29. Consequently, the respective motor frame positioning apertures 34 pass through both the first plate 30 and the second plate 31. In this example, the respective motor frame positioning apertures 34 are disposed so as to be uniformly spaced in a circumferential direction around the center line of the recess portion 29. In other words, in this example, the motor shaft positioning apertures 33 and the motor frame positioning apertures 34 are respectively disposed on two common circles that are centered around the center line of the recess portion 29. In addition, in this example, the direction in which the respective motor frame positioning apertures 34 pass through the positioning member 28 is oriented in the depth direction of the recess portion 29.

The positions at which to dispose the respective screw-threaded apertures 24 on the motor frame 2*a* are specified by the positions of the respective motor frame positioning apertures 34 when the end portion of the motor shaft 3 is inserted into the recess portion 29. In other words, the positions that face the respective motor frame positioning apertures 34 on the motor frame 2*a* when the end portion of the motor shaft 3 is inserted into the recess portion 29 (i.e., the positions on the shaft axes of the respective motor frame positioning apertures 34 on the motor frame 2*a*) are specified as the positions at which to dispose the respective screw-threaded apertures 24 on the motor frame 2*a*.

As shown in FIG. 3, permanent magnets 35 that attach magnetically to the motor frame 2*a* when the end portion of the motor shaft 3 is inserted into the recess portion 29 are disposed on the positioning member 28. In this example, the permanent magnets 35 are mounted to a surface of the first plate 30 near the motor frame 2*a*. Misalignment of the positioning member 28 on the motor frame 2*a* is prevented by the permanent magnets 35 attaching magnetically to the motor frame 2*a*.

Next, a procedure when forming the screw-threaded apertures 12 and the screw-threaded apertures 24 on the end surface of an existing motor shaft 3 and an existing motor frame 2*a* during elevator modification work will be explained. First, the end portion of the motor shaft 3 is inserted into the recess portion 29 while moving the positioning member 28 relative to the motor shaft 3. When the end portion of the motor shaft 3 is fitted into the recess portion 29, the positioning member 28 is held on the motor 1 by magnetic attachment of the motor frame 2*a* by the permanent magnets 35. The positions at which to dispose the respective screw-threaded apertures 12 on the end surface of the motor shaft 3 are thereby specified by the motor shaft positioning apertures 33, and the positions at which to dispose the respective screw-threaded apertures 24 on the motor frame 2*a* are specified by the motor frame positioning apertures 34.

Next, a drill is passed through the motor shaft positioning apertures 33, and threading preparation apertures are drilled on the end surface of the motor shaft 3 while using the motor shaft positioning apertures 33 as guides. A drill is also passed through the motor frame positioning apertures 34, and threading preparation apertures are drilled on the motor frame 2*a* using the drill while using the motor frame positioning apertures 34 as guides.

Next, thread ridges are formed on inner surfaces of the respective thread preparation apertures using a threading tap. The respective screw-threaded apertures 12 are thereby formed on the end surface of the motor shaft 3, and the respective screw-threaded apertures 24 are formed on the motor frame 2*a*. Next, the respective machining of the motor shaft 3 and the motor frame 2*a* is completed by removing the positioning member 28 from the motor 1.

In an elevator modification work apparatus of this kind, because the recess portion 29 into which an end portion of the motor shaft 3 fits is disposed on the positioning member 28, and the motor shaft positioning apertures 33 that pass through the positioning member 28 in a direction that intersects the bottom surface of the recess portion 29 are disposed on the bottom surface of the recess portion 29, positions at which to dispose the respective screw-threaded apertures 12 on the end surface of the motor shaft 3 can be specified precisely and easily by the motor shaft positioning apertures 33 simply by fitting the motor shaft 3 into the recess portion 29. Thus, it is no longer necessary to perform operations such as measuring or scribing, for example, enabling machining of the motor shaft 3 to be performed precisely and easily during elevator modification work.

Because the positioning member 28 has: the first plate 30 on which the plate penetrating aperture 32 that forms the inner surface of the recess portion 29 is disposed; and the second plate 31 that is stacked on the first plate 30, and in which a portion is exposed inside the plate penetrating aperture 32 as the bottom surface of the recess portion 29, the first plate 30 and second plate 31 can be machined separately and stacked on each other, enabling the inner surface and the bottom surface of the recess portion 29 to be formed precisely.

Because the motor frame positioning apertures 34 that pass through the positioning member 28 at positions that are radially outside the recess portion 29 are disposed on the positioning member 28, the positions at which to dispose the respective screw-threaded apertures 24 on the motor frame 2*a* can be specified precisely and simply by the motor frame positioning apertures 34 simply by fitting the motor shaft 3 into the recess portion 29. Consequently, not only machining of the motor shaft 3 but also machining of the motor frame 2*a* can be performed precisely and easily during elevator modification work.

Because the permanent magnets 35 that attach magnetically to the motor frame 2*a* when the end portion of the motor shaft 3 is inserted into the recess portion 29 are disposed on the positioning member 28, the positioning member 28 can be held on the motor frame 2*a* when the end portion of the motor shaft 3 is fitted into the recess portion 29. The position of the positioning member 28 on the motor frame 2*a* can thereby be prevented from misaligning. Consequently, the position of the drill can be prevented from misaligning when the thread preparation apertures are drilled on the end surface of the motor shaft 3 using the drill that is passed through the motor shaft positioning apertures 33, for example.

In the above example, permanent magnets 35 that attach magnetically to the motor frame 2*a* are disposed on the positioning member 28, but because the positioning member 28 is held on the motor shaft 3 by fitting the end portion of the motor shaft 3 into the recess portion 29, the permanent magnets 35 may also be omitted.

Embodiment 2

Figure 6:
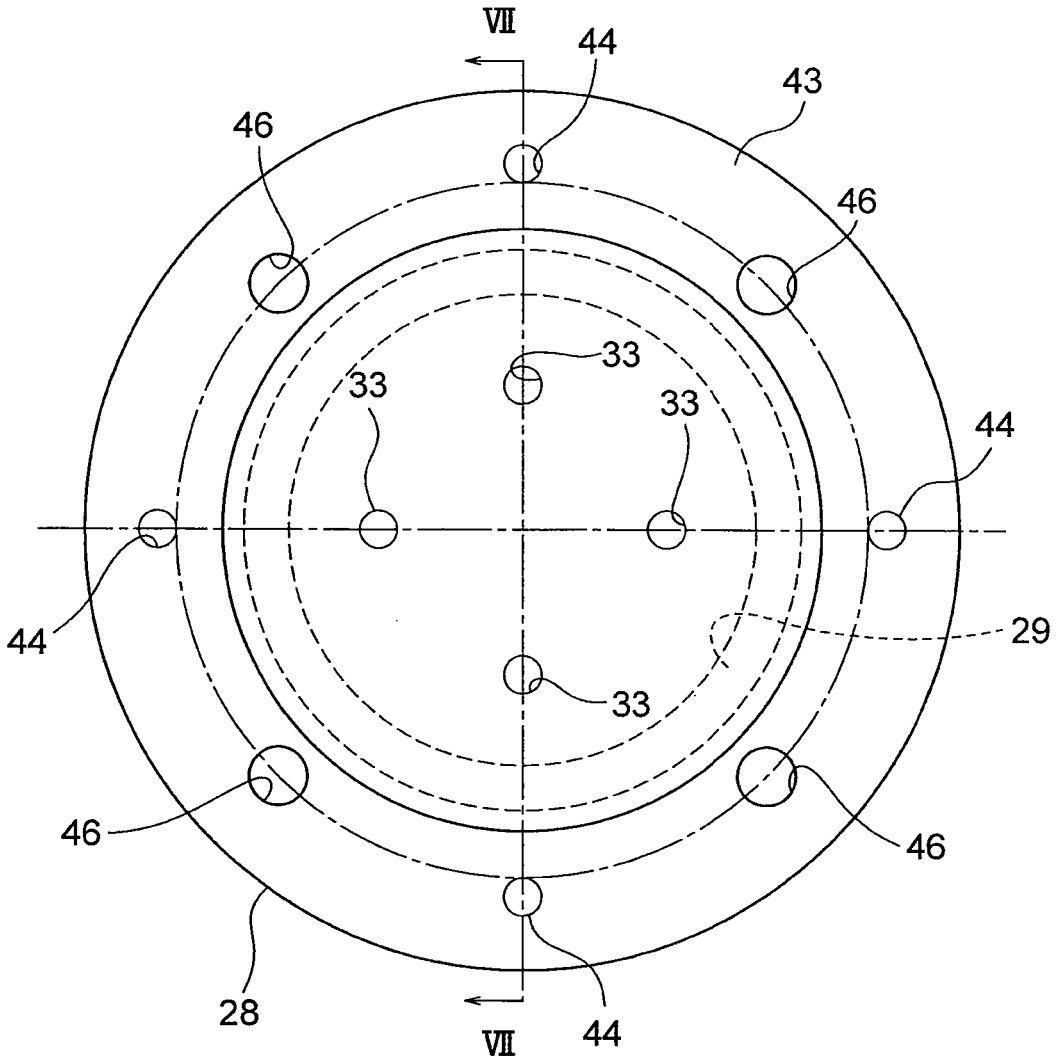
FIG. 6 is a front elevation that shows an elevator modification work apparatus according to Embodiment 2 of the present invention.
Figure 7:
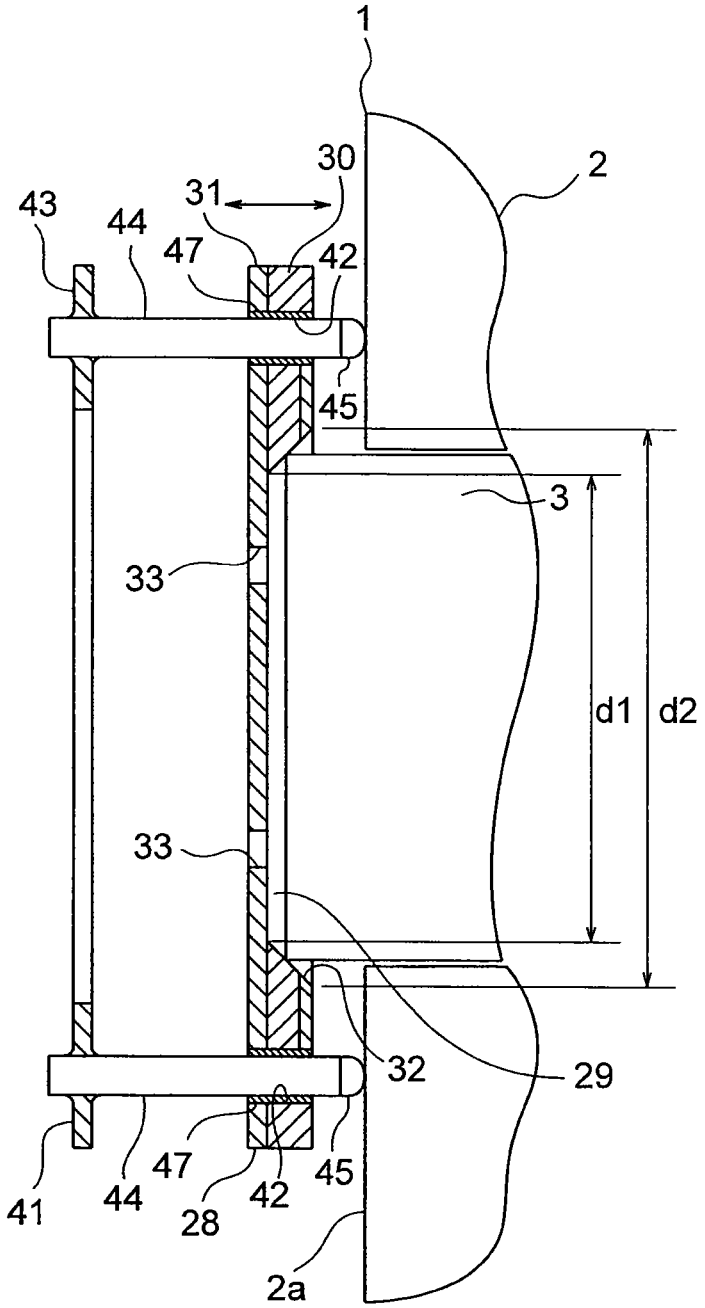
FIG. 7 is a cross section that is taken along line VII-VII in FIG. 6.

FIG. 6 is a front elevation that shows an elevator modification work apparatus according to Embodiment 2 of the present invention. FIG. 7 is a cross section that is taken along line VII-VII in FIG. 6. In the figures, an elevator modification work apparatus has: a positioning member 28; and a guiding apparatus 41 on which the positioning member 28 is disposed, and that can be mounted onto a motor frame 2*a*.

Respective external shapes of a first plate 30 and a second plate 31 that constitute the positioning member 28 are identical circular shapes. Consequently, an external shape of the positioning member 28 is circular, as shown in FIG. 6. An inner surface of a plate penetrating aperture 32 that is disposed on the first plate 30 is inclined relative to an axis of the plate penetrating aperture 32. Consequently, an inner surface of a recess portion 29 that is disposed on the positioning member 28 is inclined relative to a straight line that is parallel to a depth direction of the recess portion 29. An inside diameter of the recess portion 29 is thereby reduced continuously toward a bottom surface of the recess portion 29. Consequently, the inside diameter of the recess portion 29 is a minimum inside diameter d1 at a position near the bottom surface of the recess portion 29, and a maximum inside diameter d2 at an upper end position of the recess portion 29 that is farthest away from the bottom surface of the recess portion 29. The maximum inside diameter d2 of the recess portion 29 is greater than an outside diameter of the motor shaft 3, and the minimum inside diameter d1 of the recess portion 29 is less than the outside diameter of the motor shaft 3.

A plurality of (in this example, four) guiding penetrating apertures 42 are disposed on the positioning member 28. The respective guiding penetrating apertures 42 pass through the positioning member 28 so as to avoid each of the respective motor shaft positioning apertures 33 and the respective motor frame positioning apertures 34. The direction in which the respective guiding penetrating apertures 42 pass through the positioning member 28 is in the depth direction of the recess portion 29.

In this example, positions of the respective guiding penetrating apertures 42 are positions that are radially outside the recess portion 29. Consequently, in this example, the respective guiding penetrating apertures 42 pass through both the first plate 30 and the second plate 31. The respective guiding penetrating apertures 42 are disposed so as to be uniformly spaced in a circumferential direction around a center line of the recess portion 29. The rest of the configuration of the positioning member 28 is similar or identical to that of the configuration of the positioning member 28 according to Embodiment 1.

The guiding apparatus 41 has: a guiding shaft stationary plate (a supporting member) 43; and a plurality of (in this example, four) guiding shafts (guiding members) 44 that are respectively disposed on the guiding shaft stationary plate 43, and that pass through the respective guiding penetrating apertures 42 separately.

First end portions of the respective guiding shafts 44 are fixed to a common guiding shaft stationary plate 43 by welding, for example. The respective guiding shafts 44 are thereby disposed perpendicular to the guiding shaft stationary plate 43, and are disposed parallel to each other. Permanent magnets 45 that attach magnetically to the motor frame 2*a* are respectively disposed on second end portions of the respective guiding shafts 44. The guiding apparatus 41 is mounted to the motor frame 2*a* by the respective permanent magnets 45 attaching magnetically to the motor frame 2*a*. The shaft axes of the respective guiding shafts 44 are made parallel to the shaft axis of the motor shaft 3 by the guiding apparatus 41 being mounted to the motor frame 2*a*.

The guiding shaft stationary plate 43 functions as an annular plate that has an axis. The guiding shaft stationary plate 43 is disposed so as to be coaxial to the positioning member 28. A plurality of (in this example, four) tool passage apertures 46 are disposed on the guiding shaft stationary plate 43 so as to be aligned with positions of the respective motor frame positioning apertures 34 and so as to be coaxial to the motor frame positioning apertures 34. The tool passage apertures 46 pass through the guiding shaft stationary plate 43.

Tubular bushes 47 that slide easily on the guiding shafts 44 are respectively disposed on inner circumferential surfaces of the respective guiding penetrating apertures 42. Dry bearings, for example, are used as the bushes 47. The positioning member 28 is guided along the guiding shafts 44 as the bushes 47 slide on the guiding shafts 44.

The positioning member 28 is guided by the respective guiding shafts 44 in the depth direction of the recess portion 29 relative to the guiding shaft stationary plate 43. Consequently, when the guiding apparatus 41 is mounted to the motor frame 2*a*, the positioning member 28 is guided in the axial direction of the motor shaft 3 by the respective guiding shafts 44. The positioning member 28 is configured such that the recess portion 29 is disposed so as to face toward the motor shaft 3 when the guiding apparatus 41 is mounted to the motor frame 2*a*. Moreover, permanent magnets 35 such as those of Embodiment 1 are not disposed on the positioning member 28. The rest of the configuration is similar or identical to that of Embodiment 1.

Next, a procedure when forming the screw-threaded apertures 12 and the screw-threaded apertures 24 on the end surface of an existing motor shaft 3 and an existing motor frame 2*a* during elevator modification work will be explained. First, the guiding apparatus 41 is mounted to the motor frame 2*a* by attaching the respective permanent magnets 45 to the motor frame 2*a* with the recess portion 29 oriented toward the end surface of the motor shaft 3. At this point, the position of the guiding apparatus 41 is adjusted such that the center line of the recess portion 29 is aligned with the shaft axis of the motor shaft 3.

Next, the positioning member 28 is moved toward the motor shaft 3 under guidance from the respective guiding shafts 44. The end portion of the motor shaft 3 is thereby inserted into the recess portion 29, and an outer circumferential portion of the end surface of the motor shaft 3 contacts the inner surface (the inclined surface) of the recess portion 29. The end portion of the motor shaft 3 is placed in a fitted state in the recess portion 29 by the outer circumferential portion of the end surface of the motor shaft 3 contacting the inner surface of the recess portion 29.

When the end portion of the motor shaft 3 is fitted into the recess portion 29, the positions at which to dispose the respective screw-threaded apertures 12 on the end surface of the motor shaft 3 are specified by the motor shaft positioning apertures 33, and the positions at which to dispose the respective screw-threaded apertures 24 on the motor frame 2*a* are specified by the motor frame positioning apertures 34.

Next, a drill is passed through the motor shaft positioning apertures 33, and threading preparation apertures are drilled on the end surface of the motor shaft 3 while using the motor shaft positioning apertures 33 as guides. A drill is also passed sequentially through the tool passage apertures 46 and the motor frame positioning apertures 34, and threading preparation apertures are drilled on the motor frame 2*a* using the drill while using the tool passage apertures 46 and the motor frame positioning apertures 34 as guides. Subsequent procedure is similar or identical to that of Embodiment 1.

In an elevator modification work apparatus of this kind, because the inner surface of the recess portion 29 is inclined relative to a straight line that is parallel to the depth direction of the recess portion 29 such that the inside diameter of the recess portion 29 is reduced continuously toward the bottom surface of the recess portion 29, the inside diameter of the recess portion 29 can be varied continuously in the depth direction of the recess portion 29, enabling machining of motor shafts 3 of any outside diameter to be performed provided that the motor shaft 3 has an outside diameter that is within a range of inside diameters that are determined by the inner surface of the recess portion 29. In other words, the range of outside diameters of motor shafts 3 that can be machined can be expanded.

Because the positioning member 28 is disposed on a guiding apparatus 41 that can be mounted onto the motor frame 2*a* so as to be guided in axial direction of the motor shaft 3 by the respective guiding shafts 44 of the guiding apparatus 41 when the guiding apparatus 41 is mounted to the motor frame 2*a*, the positioning member 28 can be prevented from tilting relative to the motor shaft 3 when the motor shaft 3 is inserted into the recess portion 29. Consequently, machining of the motor shaft 3 can be performed even more precisely.

Because the permanent magnets 45 that attach magnetically to the motor frame 2*a* are disposed on the guiding apparatus 41, the state in which the guiding apparatus 41 is mounted to the motor frame 2*a* can be stabilized, enabling the position of the positioning member 28 to be prevented from shifting relative to the motor frame 2*a*.

Moreover, in the above example, permanent magnets 45 are disposed on the respective guiding shafts 44, but because the guiding apparatus 41 can be mounted to the motor frame 2*a* while the respective guiding shafts 44 are pressed against the motor frame 2*a* by a worker, for example, the permanent magnets 45 may also be omitted.

In the above example, the positioning member 28 is disposed on the guiding apparatus 41, but because the end portion of the motor shaft 3 can also be inserted into the recess portion 29 such that the positioning member 28 does not tilt relative to the motor shaft 3 even without the guiding apparatus 41, the guiding apparatus 41 may also be omitted.

In the above example, a positioning member 28 in which the inner surface of the recess portion 29 is inclined is disposed on the guiding apparatus 41, but the positioning member 28 according to Embodiment 1, in which the inside diameter of the recess portion 29 was kept constant in the depth direction of the recess portion 29 may also be disposed on the guiding apparatus 41.

In each of the above embodiments, the positioning member 28 is configured by stacking the first plate 30 and the second plate 31 on each other, but the positioning member 28 may also be configured by disposing the recess portion 29 on a single member.

In each of the above embodiments, the motor shaft positioning apertures 33 and the motor frame positioning apertures 34 are both disposed on the positioning member 28, but the motor frame positioning apertures 34 may also be omitted from the positioning member 28 if the screw-threaded apertures 24 are formed on the motor frame 2*a* in a separate step from the screw-threaded apertures 12.

In each of the above embodiments, the respective external shapes of the first plate 30 and the second plate 31 are identical, but the respective external shapes of the first plate 30 and the second plate 31 may also be different than each other. The external shape of the first plate 30 may also be circular, and the external shape of the second plate 31 rectangular, for example.

EXPLANATION OF NUMBERING

2A MOTOR FRAME, 3 MOTOR SHAFT, 12 SCREW-THREADED APERTURES (COUPLING SHAFT MOUNTING APERTURES), 24 SCREW-THREADED APERTURES (EXTERNAL EQUIPMENT MOUNTING APERTURES), 28 POSITIONING MEMBER, 29 RECESS PORTION, 30 FIRST PLATE, 31 SECOND PLATE, 32 PLATE PENETRATING APERTURE, 33 MOTOR SHAFT POSITIONING APERTURES, 34 MOTOR FRAME POSITIONING APERTURES, 35 PERMANENT MAGNETS, 41 GUIDING APPARATUS, 43 GUIDING SHAFT STATIONARY PLATE (SUPPORTING MEMBER), 44 GUIDING SHAFTS (GUIDING MEMBERS), 45 PERMANENT MAGNETS.

The invention claimed is:

1. An elevator modification work apparatus applied to an end surface of a rotatable motor shaft of a motor having the motor shaft and a motor frame provided around the motor shaft, the elevator modification work apparatus comprising:

a positioning member having a plate shape with opposed surfaces;

a recess in one of the opposed surfaces of the positioning member, the recess having a depth that is less than a thickness of the positioning member between the opposed surfaces such that the recess does not extend entirely through the positioning member in the thickness direction, whereby the recess has a bottom surface, wherein the recess has a shape and size permitting the end of the motor shaft to be inserted therein, and permitting the positioning member to rotate in a direction of rotation of the motor shaft while prohibiting movement of the positioning member relative to the motor shaft in any direction perpendicular to the direction of rotation of the motor shaft when the end of the motor shaft is inserted into the recess and the elevator modification work apparatus is applied to the end surface of the motor shaft; and at least one motor shaft positioning aperture that passes through the positioning member from the other of the opposed surfaces in a direction that intersects the bottom surface of the recess.

2. The elevator modification work apparatus according to claim 1, wherein the positioning member comprises:

a first plate on which a plate penetrating aperture that forms an inner surface of the recess is disposed; and a second plate that is stacked on the first plate, a surface of the second plate comprising the bottom surface of the recess.

3. The elevator modification work apparatus according to claim 1, further comprising at least one motor frame positioning aperture that passes through the positioning member at a position that is radially outside the recess and that corresponds to a radial location of the motor frame when the end of the motor shaft is inserted into the recess.

4. The elevator modification work apparatus according to claim 1, further comprising a permanent magnet provided to the positioning member at a location such that the positioning member is magnetically held onto the motor frame by the permanent magnet when the end of the motor shaft is inserted into the recess.

5. The elevator modification work apparatus according to claim 1, wherein:

an inner surface of the recess is inclined relative to a straight line that is parallel to a depth direction of the recess; and an inside diameter of the recess is reduced continuously toward the bottom surface of the recess.

6. The elevator modification work apparatus according to claim 5, further comprising a guiding apparatus comprising:

a supporting member; and a plurality of guiding members that are respectively disposed on the supporting member, and that guide the positioning member in the depth direction of the recess relative to the supporting member, the guiding apparatus being mountable onto the motor frame that is disposed around the motor shaft, the positioning member being guided in an axial direction of the motor shaft by each of the guiding members when the guiding apparatus is mounted to the motor frame.

7. The elevator modification work apparatus according to claim 6, further comprising a permanent magnet that attaches magnetically to the motor frame and is disposed on the guiding apparatus.

* * * * *